United States Patent [19]

Pergande et al.

[11] 4,397,393

[45] Aug. 9, 1983

[54] FAST FOOD CARRYOUT PACKAGE

[75] Inventors: Michael W. Pergande, Stone Mountain, Ga.; Anthony Giusto, Parsippany, N.J.

[73] Assignee: The Coca-Cola Company, Atlanta, Ga.

[21] Appl. No.: 272,021

[22] Filed: Jun. 9, 1981

[51] Int. Cl.[3] ..... B65D 5/42; B65D 5/44; B65D 5/46

[52] U.S. Cl. ..... 206/549; 206/216; 206/45.31; 229/28 R; 229/41 B; 229/52 B

[58] Field of Search ..... 206/216, 45.31, 427, 206/549; 229/52 B, 41 B, 41 R, 27, 28 R

[56] References Cited

U.S. PATENT DOCUMENTS

| | | | |
|---|---|---|---|
| 2,659,526 | 11/1953 | Buttery | 229/41 B |
| 2,822,917 | 2/1958 | Toensmeier | 206/45.31 |
| 3,054,505 | 9/1962 | Hennessey | 206/216 |
| 3,126,145 | 3/1964 | Struble | 229/52 B |
| 3,233,726 | 2/1966 | Gero | 206/45.31 |
| 3,640,380 | 2/1972 | Huffman | 229/52 B |

FOREIGN PATENT DOCUMENTS

| | | |
|---|---|---|
| 1192032 | 5/1970 | United Kingdom . |
| 2035961 | 6/1980 | United Kingdom . |

*Primary Examiner*—William T. Dixson, Jr.
*Attorney, Agent, or Firm*—Birch, Stewart, Kolasch & Birch

[57] ABSTRACT

A carryout package is provided for transporting a container of beverage in conjunction with other foods and the like, the container being initially collapsed as a two layer flat blank erectable to form a rectangular box with a generally triangular cross-section at the top. A fold-over flap and port structure forms an integral handle in the top of the package and one corner contains an inwardly collapsible section to form an interior partition across the package to define a beverage container receiving compartment further bounded by the sidewalls and one end wall of the package. The collapse of the corner section provides ports in one side and one end wall through which the container of beverage can be observed.

7 Claims, 11 Drawing Figures

FAST FOOD CARRYOUT PACKAGE

FIELD OF THE INVENTION

This invention relates to fast food carry-out packages and more particularly to a collapsible fast food carry-out package having one corner thereof inwardly collapsible such that a compartment is created for carrying a container of beverage or the like which is partitioned from the other items such as food and the like in the carry-out package.

BACKGROUND OF THE INVENTION

In the fast food industry it is desirable to utilize protective packages for carry-out orders in the form of collapsed containers which are readily erected into their final shape by the simple expedient of unfolding a flattened paperboard blank. While such containers are available in the art for single compartment groupings of food and the like there is a need in the art for such packages which will carry a container of beverage and maintain that beverage container isolated from the food and other items in the package. It is also desirable to effect this adaptability of an erectable pre-collapsed container which will visibly display the beverage container from outside the food container so that point of purchase advertising on the containers is readily discernible. Further, in establishments where different beverages are served in containers which are characteristic of a particular beverage the visibility of the beverage container serves to identify the particular order within a container to an ultimate group of recipients.

It is an object of the present invention to provide a new and novel fast food carry-out package having a beverage container compartment defined therein.

It is therefore an object of the present invention to provide a carry-out package for fast foods and the like which includes a partitioned receiving chamber for a container of beverage and which partitions that container of beverage from the other contents of the carry-out package.

It is another object of the present invention to provide an erectable pre-collapsed container for carry out foods and a container of beverage in which one corner of the erectable package is inwardly deformable to provide a pocket for receiving and maintaining the container of beverage in a stable position within the carry out container but partitioned from the other items therein.

These and other objects of the present invention will become more fully apparent with reference to the following specification and drawings which relate to a preferred embodiment of the invention.

SUMMARY OF THE INVENTION

The fast food carry-out package of the present invention comprises a substantially rectangular collapsed blank having two end walls, two side walls, and a multi-flap bottom configuration. There are also provided a fold-over flap and interlocking means for making a handle consisting of a pair of elongated hand grip ports in opposite sidewalls, at least one of the ports having a fold-in-tab cooperating with a portion of the fold-over flap to provide a grip for the carry out package. One end wall and an adjacent portion of one side wall of the container is provided with a figure-8-shaped punched out section with the "8" lying on its side to provide a waisted effect at one corner of the package. This figure-8 shape, which can be described as a "lazy-8" since it is lying on its side, has fold lines across the sides of the 8 and another fold line across a widened waist portion such that when the carry-out package is erected into a rectangular three-dimensional configuration, the entire corner section may be punched inward such that the waist line of the lazy-8 defines an interior corner and the circular or eye shaped portions of the lazy-8 form two interior partitions. One interior partition is perpendicular to the side wall from which it was punched to provide an internal partition for preventing a container of beverage placed adjacent thereto on the interior bottom wall of the erected package, from engaging with the remaining contents of the package on the opposite side of that partition wall.

The top portion of the container is closeable by scored flap means at the opposite end of the container from the lazy 8 configuration and by an infolding trapezoidal flap means above one portion of the lazy-8 configuration on that end wall which includes a portion of the lazy-8. The fold-over flap previously described extends the length of the package and includes a central fold-in tab which tucks under through one elongated hand-grip port in the opposite side wall from the base of the fold-over flap, to cooperate with an inturned punched-out conformal tab in the other elongated hand-grip port in the same side wall as the fold-over flap to form a handle portion of triangular cross-section having a widened part internally disposed in the uppermost part of the package to provide a carrying handle therefor.

Furthermore, the configuration of the fold-over flap and interlocking tabs in the hand-grip ports basically preclude foreign matter from entering the package and assist in maintaining the contents of the package at the serving temperature provided therein when placed in the package. If the beverage is a cold beverage, the internal partition formed by the side wall portion of the lazy-8 helps to prevent heat exchange of any rapid nature between the cold beverage and warm food within the package. Likewise, hot beverages are also isolated from the contents of the package on the other side of the internal partition formed by the lazy-8 section.

DETAILED DESCRIPTION OF THE DRAWINGS

Figure 1:
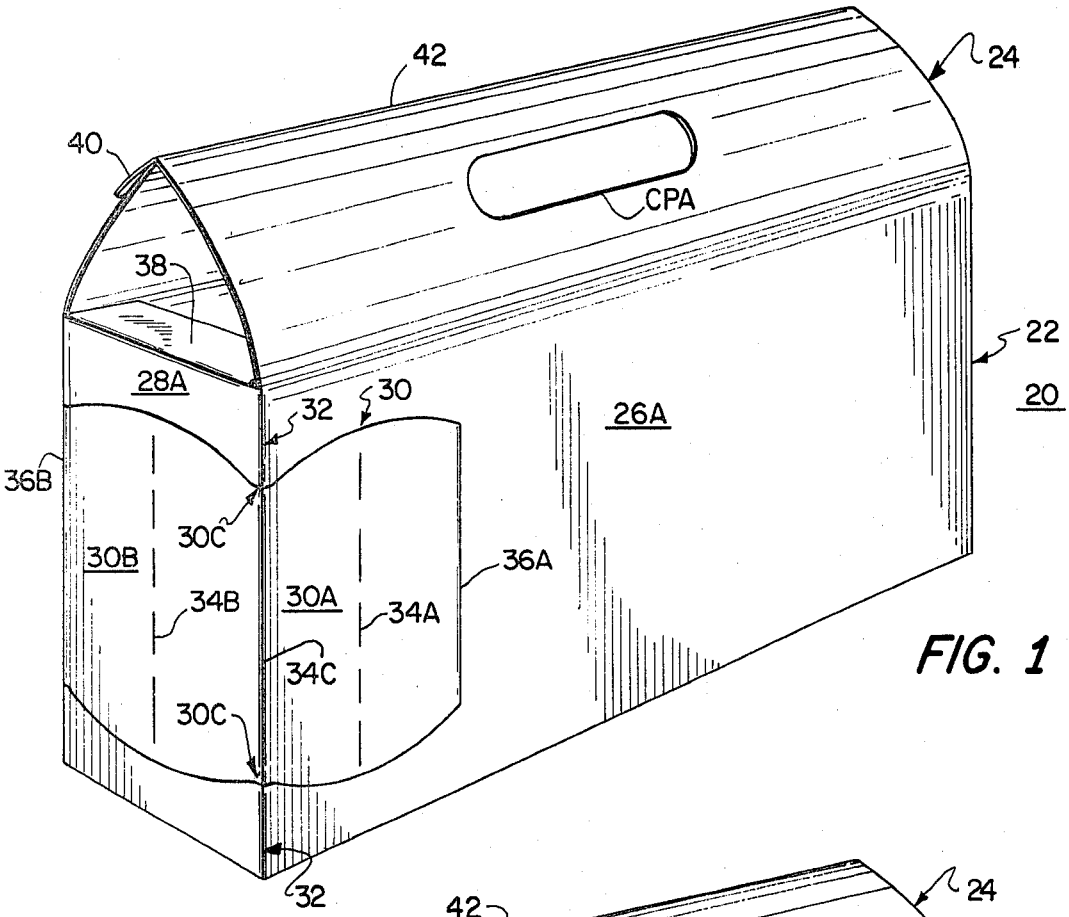
FIG. 1 is a perspective of the carry-out package of the present invention with the lazy-8 configuration still in its uncollapsed externally facing configuration.
Figure 2:
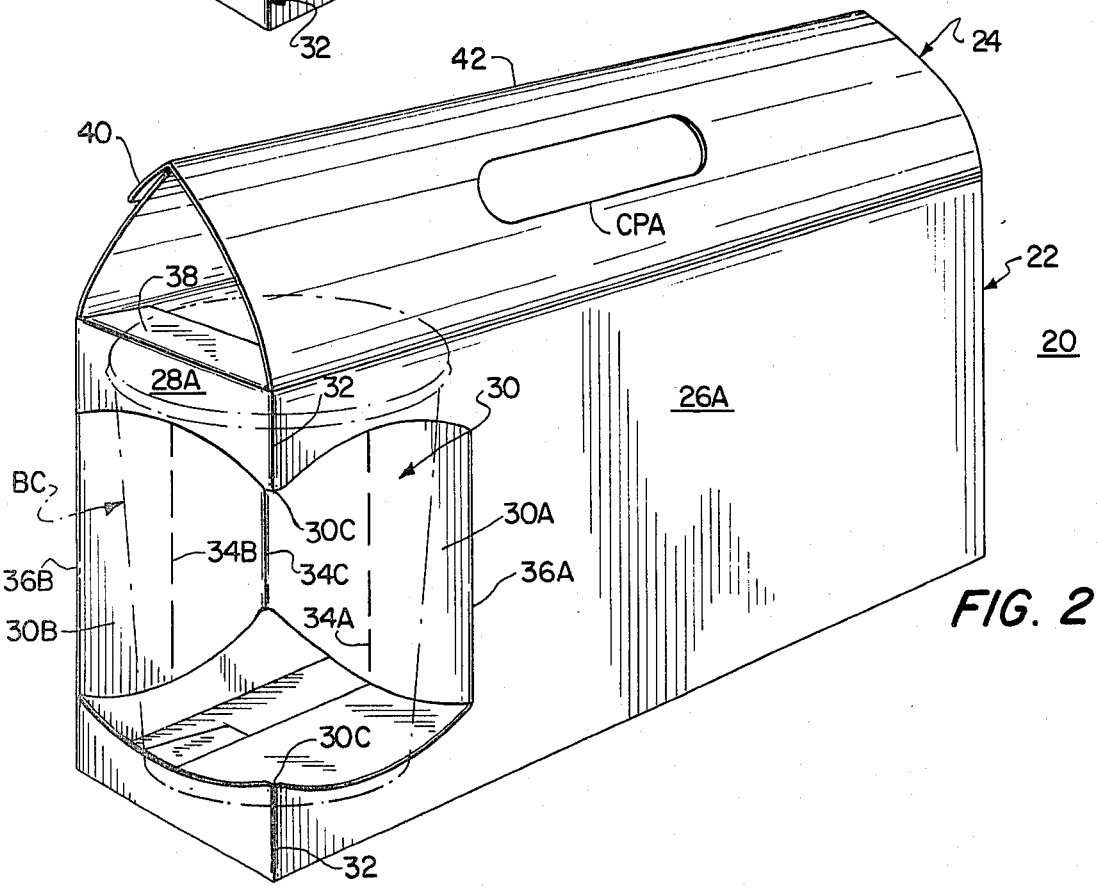
FIG. 2 is a perspective of the carry-out package of the present invention with the lazy-8 configuration punched inwardly in the provision of a beverage container receiving cavity.

Referring in detail to the drawings and with particular reference to FIGS. 1 and 2, the carry out package 20 of the present invention is shown as including a lower, basically rectangular, three-dimensional erect portion 22 with an upper portion 24 of triangular cross-section coterminate therewith. A first rectangular side wall 26A is illustrated as merging at one end with a first vertically standing rectangular end wall 28A, the side wall 26A and end wall 28A having respective counterparts 26B and 28B to be illustrated hereinafter. A lazy-8 configuration 30 is arranged with one half 30A thereof in the sidewall 26A and the other half 30B thereof in the end wall 28A with the waist line of the lazy-8 configuration 30 forming corner apices 30C in that vertical corner 32 of the container 20 formed by the intersection of the first side and end walls 26A and 28A. Each half 30A, 30B of the lazy-8 configuration 30 is bisected by a corresponding fold line 34A, 34B and the wasp-waist portion of the lazy-8 configuration 30 is defined by a score line or fold line 34C extending between the corner apices 30C.

The extreme right and left end portions 36A and 36B of the lazy-8 configuration 30 are defined by fold lines but are not severed from the first side wall 26A and first end wall 28A in which the halves 30A and 30B are disposed while the remainder of those halves 30A and 30B of the lazy-8 configuration 30 are completely cut through the respective walls such that pressure on the corner fold line 34C will cause it to collapse inwardly by virtue of bending along the medial fold lines 34A and 34B in the respective halves 30A and 30B so that the fold line 34C moves all the way into the container 20 to form an internal corner as illustrated in FIG. 2. The side wall half 30A now extends perpendicularly to the side wall 26A and the second or end wall half 30B of the lazy-8 configuration 30 lies juxtaposed with and parallel to the opposite second side wall 26B as is best illustrated with reference to the cross-sectional detail of FIG. 9. Thus, a rectangular internal compartment open to the exterior of the package but partitioned from the remainder of the package is provided such that a container of beverage BC, illustrated in phantom lines in FIG. 2, can be positioned within the carry-out package 20 in relative isolation from other items within the package.

At the upper end of the side wall portion 28A in a trapezoidal inwardly folded flap 38 which partially engages the interior walls of the upper section 24 of the package 20 to provide a sufficient amount of rigidity to that particular end of the erected package.

Also, as can be seen from FIGS. 1 and 2 there is a fold-over flap 40 which extends from the apex or top line 42 of the package 20 down one side of the upper section 24 as will be hereinafter more fully described. Additionally, in the respective upper portions of the first and second side walls 26A and 26B in the upper portion 24 of the package 20 are provided opposed carrying (hand-grip) ports CPA and CPB which are of an elongated substantially oval configuration to permit the fingers of a person carrying the package 20 to be inserted therethrough from either side.

Further, as illustrated in FIG. 2, the corner apices 30C are joined with the extremities of the fold lines 36A and 36B on the opposite remote ends of the lazy 8 configuration 30 by arcuate edges which define a scalloped opening through which the beverage container BC mounted with the package 20 is visible.

Figure 6:
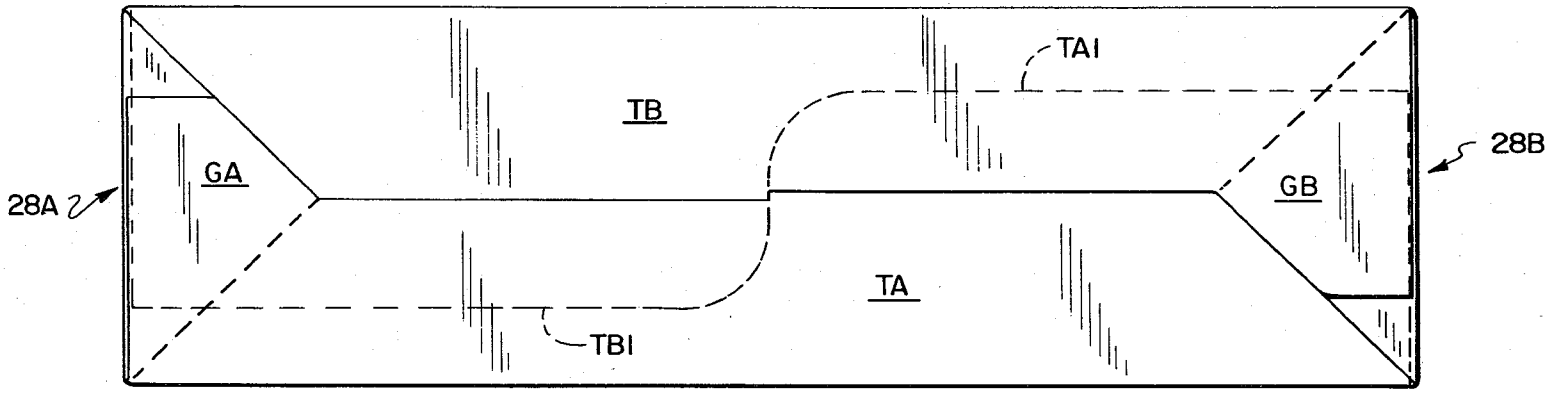
FIG. 6 is a bottom plan view of the erected carry-out package of the present invention.
Figure 7:
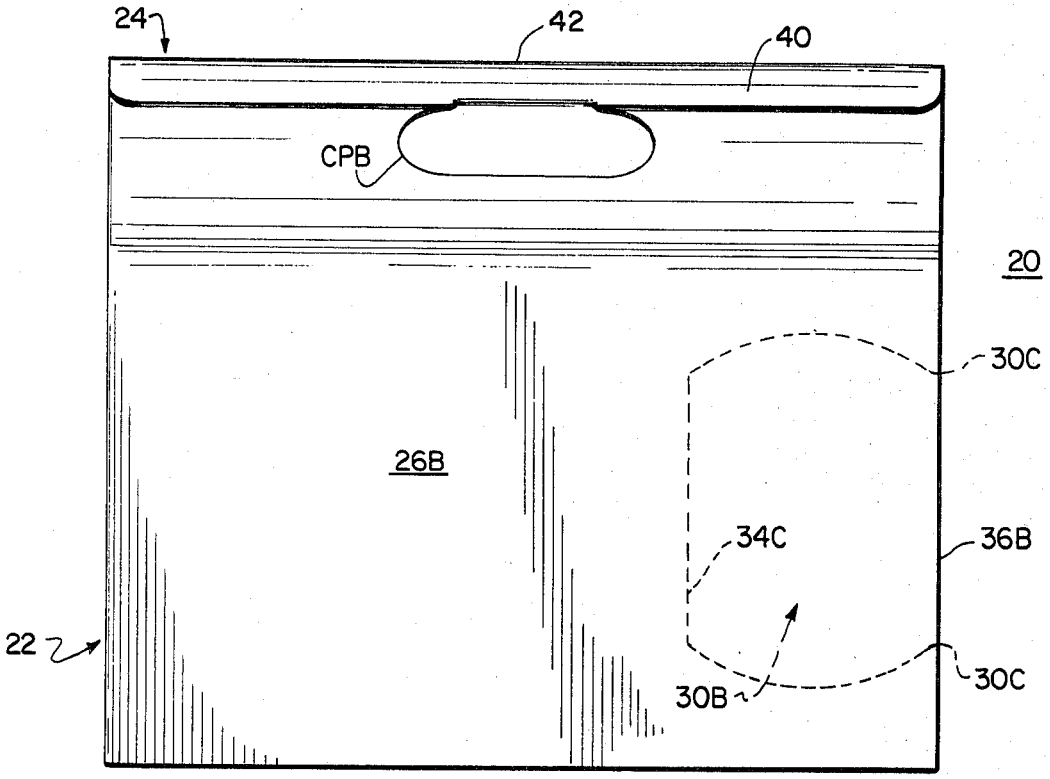
FIG. 7 is a side elevation of that side of the erected carry-out package of the present invention which does not contain a portion of the lazy-8 configuration.

Referring next to FIGS. 3, 4, 5, 6, and 7 and 8, both of the hand-grip ports CPA and CPB and their relationship to the fold-over flap 40, top line 42 and upper portion 24 of the package 20 are clearly illustrated. Further illustrated in FIG. 7 is the second sidewall 26B of the container 20 with the inwardly folded portion 30B of the lazy-8 configuration 30 illustrated in dotted lines in its inwardly folded relationship thereto.

Figure 8:
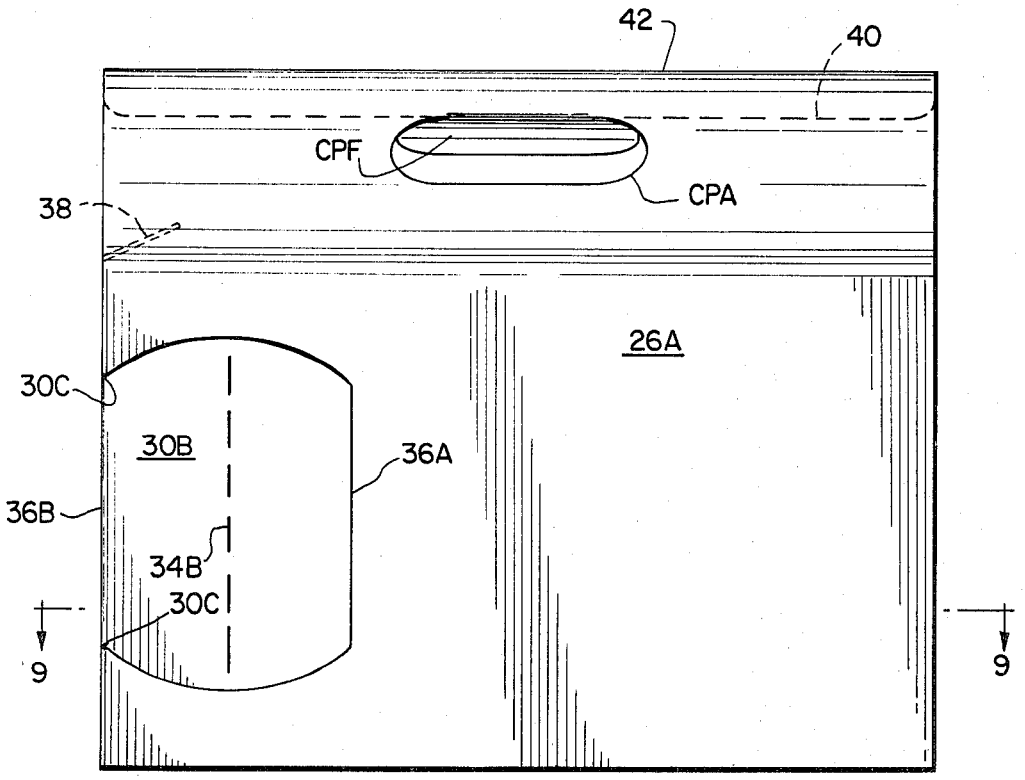
FIG. 8 is a side elevation of the opposite side of the erected carry-out package of the present invention which includes a portion of the lazy-8 configuration thereof.

A solid line illustration of the first sidewall 26A of the package 20 is illustrated in FIG. 8 and illustrates a partially punched-out carrying flap CPF in the hand-grip port CPA in the upper portion of the said first sidewall 26A of the container 20.

Figure 3:
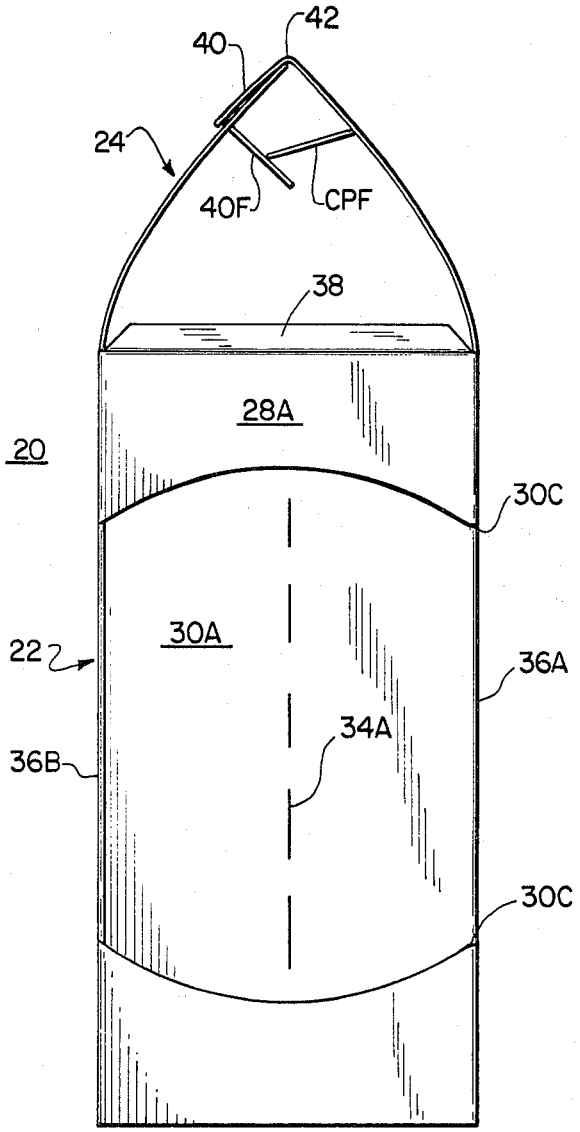
FIG. 3 is an end view of that end of the package of the present invention which includes part of the lazy-8 configuration.

As best shown in FIG. 3, the carrying flap CPF is folded inwardly and cooperates with an inwardly folded tab 40F (from the fold-over flap 40) which extends through the hand-grip port CPB in the upper portion of the sidewall 26B of the container 20. When the fingers of a user are inserted through the hand-grip ports CPA and CPB, the overlapping tab 40F and carrying flap CPF form a flat base of a triangular grip which is of sufficient strength, durability and comfort to provide a suitable carrying handle configuration integral with the upper portion 24 of the container 20.

Figure 4:
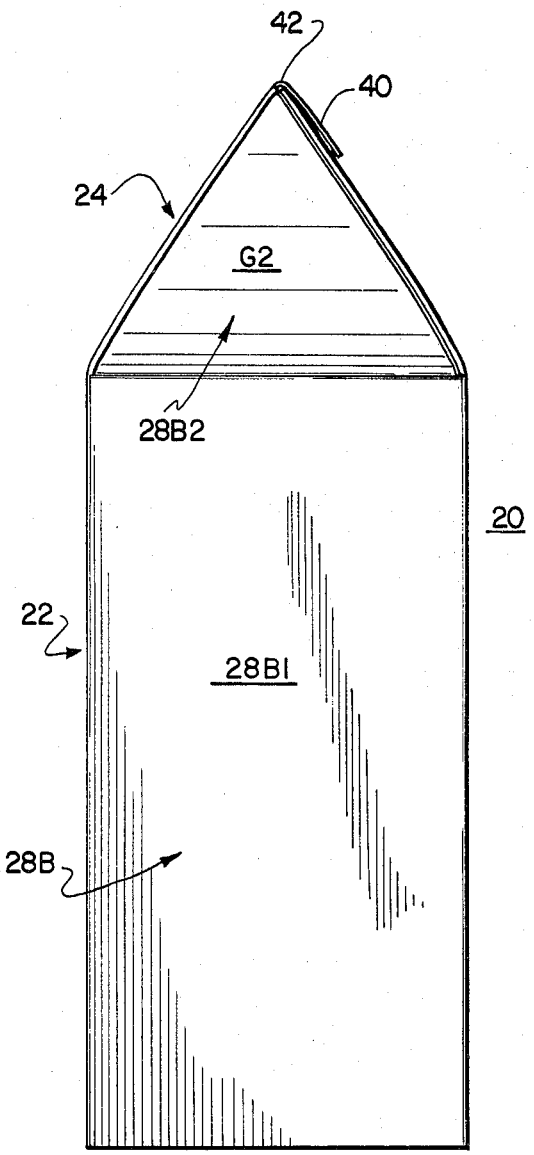
FIG. 4 is an end view of the opposite end of the carry-out package of the present invention.
Figure 5:
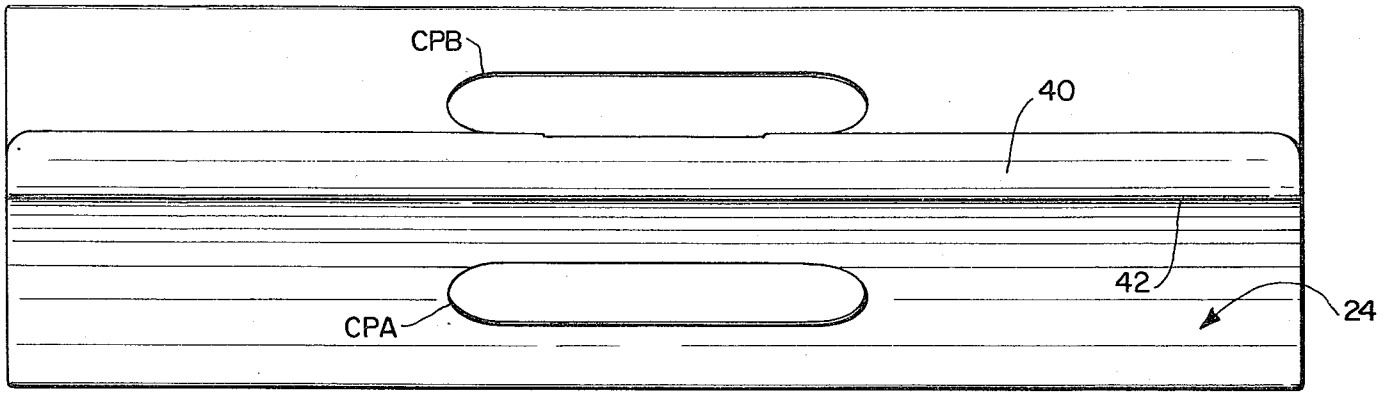
FIG. 5 is a top plan view of the carry-out package of the present invention.
Figure 11:
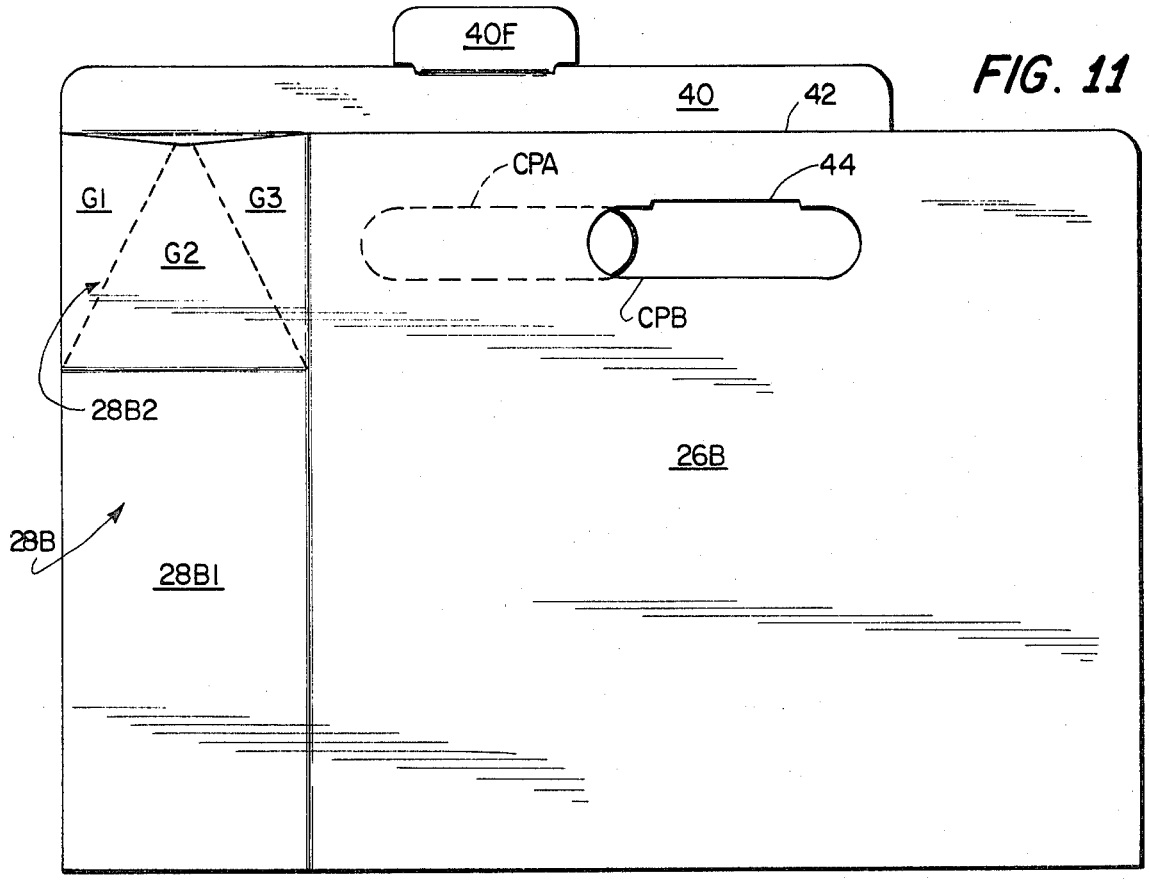
FIG. 11 is an opposite side plan view of the collapsed carry-out package of the present invention illustrating the fold lines in the closed end thereof in which no portion of the lazy-8 configuration is present.

The second end wall 28B of the container 20 is illustrated in FIG. 4 in its erected configuration and in FIG. 11 in its collapsed configuration. This second end wall structure consists of a lower rectangular section 28B1 and an upper section 28B2 having basically triangular fold lines therein to form aligned, internally collapsible, triangular gussets G1, G2, and G3 such that the center gusset G2 provides a smooth transition between the rectangular portion 28B1 of the end wall 28B and the triangular cross-section of the upper portion 24 of the package 20 as illustrated in FIG. 4. The outer ones G1 and G3 of the three aligned gussets collapse inwardly and lie against the convergent portions of the first and second side walls 26A and 26B which make up the upper portion 24 of the package 20. This provides sufficient strength and rigidity at the opposite end of the package 20 to maintain it in its erected condition and to further strengthen the upper portion 24 and its integral handle formed by the hand-grip ports CPA, CPB and the inturned flap CPF and tab 40F.

Referring for the moment to FIG. 11, it is noted that the hand-grip port CPB in the second side wall 26B has a relieved edge portion 44 which is configured to receive the folded-in tab 40F which extends into the port CPB from the folded overlay flap 40 (in the configuration best illustrated in FIG. 3).

Figure 9:
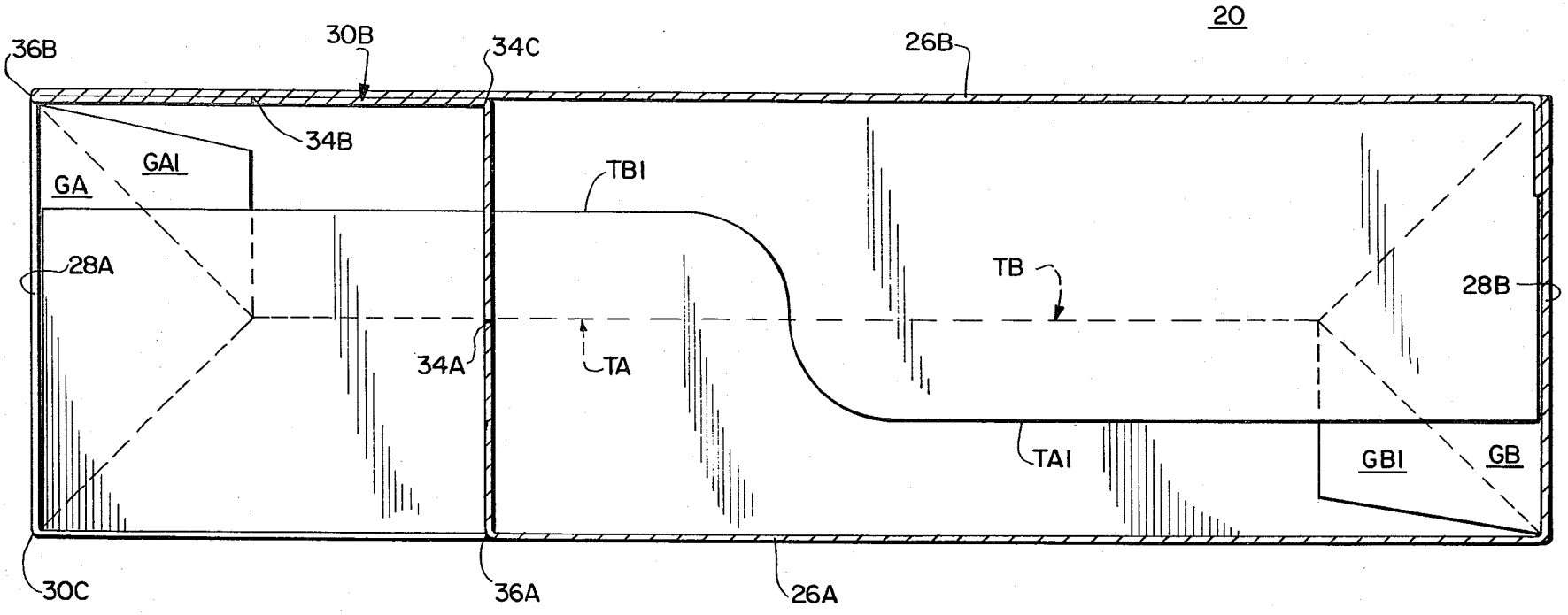
FIG. 9 is a cross-sectional detail of the interior bottom portion of the carry-out package taken along line 9—9 of FIG. 8 and illustrating in cross-section the interior partitions formed by collapsing inwardly the lazy-8 configuration of the present invention.

Referring jointly to FIGS. 6 and 9, the bottom structure of the carry-out package 20 of the present invention is shown as consisting of two basic overlying flap structures having triangular end gusstes GA and GB adjacent the first and second end walls 28A and 28B with the bases of the triangles comprising the lowermost boundary lines of those respective end walls.

Each of the triangular gussets GA and GB has one cut line thereon which is indicated in solid lines in FIG. 6 and one fold line defined therein by the dotted lines in FIG. 6. Extending from the dotted fold lines of the gussets GA, GB are a basically elongated inter-locking tabs TA and TB, respectively, which have elongated interlocking portions TA1 and TB1 shown in dotted line configurations in FIG. 6 and in solid line configurations in FIG. 9. Adjacent to the Gussets GA and GB are extraneous flap portions GA1 and GB1 respectively, which are not glued outside of the dotted score lines defining the gussets GA and GB in FIG. 9 and FIG. 6 such that these flaps do not interfer with the bending of the gussets GA and GB along the respective score lines therein.

OPERATION OF THE INVENTION

Figure 10:
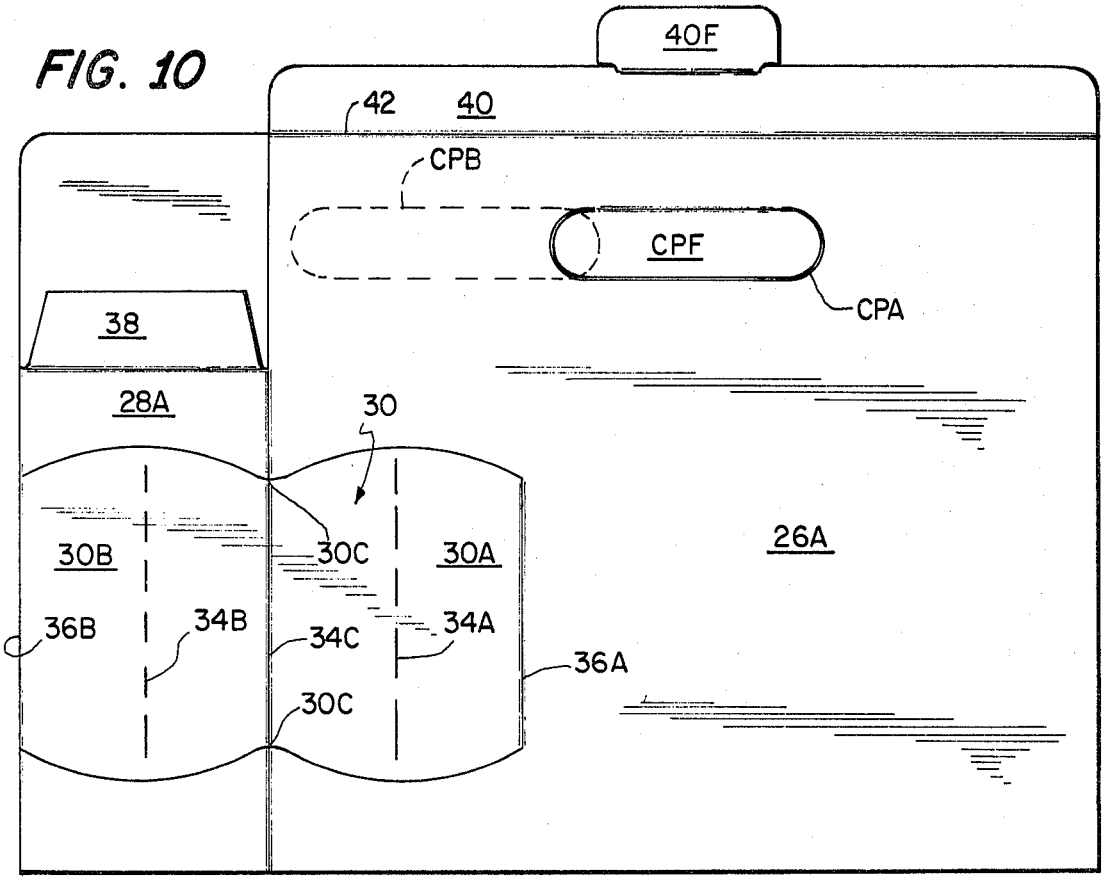
FIG. 10 is a side elevation of a collapsed blank configuration of the carry-out package of the present invention illustrating the fully laid out form of the lazy-8 configuration thereof.

When the time comes to utilize a carry out package of the present invention to include a food order and container of beverage BC, the operator at the fast food establishment picks up the package 20 in the configuration illustrated in FIGS. 10 and 11 and slides the first and second sidewalls 26A and 26B parallel one to the other until such time as the first and second end walls 28A and 28B become respectively parallel to each other and perpendicular to the said sidewalls 26A and 26B. At this time the operator reaches inside the upper end of the still open upper section 24 and causes the bottom gussets GA and GB and the associated interlocking tabs TA and TB and interlocking portions TA1 and TB1 thereof to interengage and form a rigid bottom section as illustrated in FIGS. 6 and 9 such that the first and second side walls 26A, 26B and first and second end walls 28A, 28B remain in their desired mutually parallel and perpendicular relationship as described above.

At that point in time, pressure is applied to the corner seam or fold line 34C along the waist of the lazy-8 configuration 30 such that the configuration collapses inwardly to assume the position illustrated in FIGS. 2 and 9, whereby an internal rectangular compartment partitioned from the remainder of the package 20 is provided to receive a beverage container BC therein through the open upper portion 24 of the container 20.

Then the remaining compartment to the right of the partition defined by the lazy-8 section 30A is filled with the various food items and other paraphernalia that belong with a particular food and beverage order and the upper portion of the package is closed by pressing inward on the central gusset G2 on the second end wall 28B and the flaps 38 on the first end wall 28A and thereafter, bringing the fold-over flap 40 down over the second sidewall 26B and forcing its tab 40F into the hand-grip port CPB while at the same time forcing the carrying flap CPF inward into underlying relationship or overlying relationship (as the case may be) with the fold-over tab 40F to thereby maintain the fold-over flap 40 against the uppermost end of the sidewall 26B and provide a relatively rigid and strong carrying handle integral with the upper portion 24 of the container 20.

Thereafter the package is handed to the customer who can readily transport it from the premises.

As can be seen from the foregoing specification and drawings this invention provides a new and novel and easily erectible precollapsed package structure for carry out use in fast food establishments or the like wherein a beverage container BC is to be included with the order.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Carryout package means for transporting containers of beverage and the like in conjunction with other foodstuffs comprising:

a pair of parallel end walls and a pair of parallel sidewalls joined together to define corners, said package being foldable at said corners between a collapsed state and an erect state;

a bottom wall comprising interlocking means attached to said side and end walls and disengaged in said collapsed state and interlocked in said erect state to define a bottom wall for said package means;

closure defining folding flap means attached to said side and end walls for closing said package means in said erect state, said closure defining means including integral handle forming means for providing a carrying handle for said package means; and collapsible corner means in one of said corners defined between one of said sidewalls and one of said end walls for defining, in a collapsed state thereof, an internal partition extending between said sidewalls and forming a container receiving and transporting compartment bounded by at least one of said sidewalls, said internal partition and said one of said end walls and a food receiving compartment bounded by said sidewalls, said internal partition and the other end wall.

2. The carryout package means of claim 1, wherein said collapsible corner means comprises a first portion located in said one of said sidewalls, said first portion, in the collapsed state, comprising said internal partition, and a second portion located in said one of said end walls and interconnecting said internal partition with the other of said sidewalls.

3. The carryout package means of claim 2, wherein said first and second portions are so shaped and so proportioned as to form a waist at said one of said corners.

4. The carryout package means of claim 2, wherein said first and second portions are so shaped and so proportioned as to form a waist at said one of said corners; and wherein said first and second portions include scored fold line means intermediate their extremities for enhancing the ability of said collapsible corner means to fold inwardly;

said second portion lying parallel to said other of said sidewalls and extending to the corner between the latter and said one of said end walls in the inwardly collapsed state of said collapsible corner means.

5. The carryout package means of any of claims 1, 2, 3, or 4, wherein open port means are defined in said one sidewall and said one end wall when said collapsible corner means is in said collapsed state whereby a container within said container receiving and transporting compartment may be viewed from the exterior of said package.

6. The carryout package means of any of claims 1, 2, 3, or 4, wherein said closure defining folding flap means comprises:

fold-over flap means coterminate with the uppermost edge of one of said sidewalls and including score line means for folding said fold-over flap means into overlying relationship with the uppermost portion of the other of said sidewalls; and said integral handle forming means comprises:

folding tab means dependent from said fold-over flap means;

opposing hand-grip port means in each of said sidewalls adjacent said fold-over flap means;

fold-in flap means affixed to said one of said sidewalls and foldable into said hand-grip port means in said one sidewall;

the opposite one of said hand-grip port means receiving said folding tab means upon folding of the latter;

said folding tab means and said fold-in flap means overlapping within said package means for providing a handle structure for carrying said package means.

7. The carryout package means of any of claims 1, 2, 3, or 4, wherein said closure defining folding flap means comprises:

fold-over flap means coterminate with the uppermost edge of one of said sidewalls and including score line means for folding said fold-over flap means into overlying relationship with the uppermost portion of the other of said sidewalls; and said integral handle forming means comprises:

folding tab means dependent from said fold-over flap means;

opposing hand-grip port means in each of said sidewalls adjacent said fold-over flap means;

fold-in flap means affixed to said one of said sidewalls and foldable into said hand-grip port means in said one sidewall;

the opposite one of said hand-grip port means receiving said folding tab means upon folding of the latter;

said folding tab means and said fold-in flap means overlapping within said package means for providing a handle structure for carrying said package means; and further, wherein when said collapsible corner means is in said collapsed state open port means are defined in said one sidewall and in said one end wall for viewing a container within said container receiving and transporting compartment.

* * * * *